US011045818B2

(12) United States Patent
Knorr et al.

(10) Patent No.: US 11,045,818 B2
(45) Date of Patent: Jun. 29, 2021

(54) HYDROCYCLONE SEPARATOR

(71) Applicant: Metso Minerals Industries, Inc., Waukesha, WI (US)

(72) Inventors: Brian Knorr, Henrico, VA (US); Lars Grönvall, Trelleborg (SE)

(73) Assignee: Metso Minerals Industries, Inc., Waukesha, WI (US)

( * ) Notice: Subject to any disclaimer, the term of this patent is extended or adjusted under 35 U.S.C. 154(b) by 0 days.

(21) Appl. No.: 16/624,388

(22) PCT Filed: Jun. 22, 2018

(86) PCT No.: PCT/US2018/038942
§ 371 (c)(1),
(2) Date: Dec. 19, 2019

(87) PCT Pub. No.: WO2018/237240
PCT Pub. Date: Dec. 27, 2018

(65) Prior Publication Data

US 2020/0122163 A1 Apr. 23, 2020

(30) Foreign Application Priority Data

Jun. 22, 2017 (EP) ..... 17177481

(51) Int. Cl.
*B04C 5/12* (2006.01)
*B04C 5/04* (2006.01)
(Continued)

(52) U.S. Cl.
CPC ..... *B04C 5/12* (2013.01); *B04C 5/04* (2013.01); *B04C 5/23* (2013.01); *B04C 5/24* (2013.01)

(58) Field of Classification Search
CPC ..... B04C 5/12; B04C 5/22; B04C 5/23
See application file for complete search history.

(56) References Cited

U.S. PATENT DOCUMENTS 4,265,741 A * 5/1981 Im ..... B04C 3/00 209/725
2008/0000810 A1* 1/2008 Garner ..... C10G 31/10 208/390
2008/0092734 A1* 4/2008 Benner ..... B01D 45/16 95/26

FOREIGN PATENT DOCUMENTS

CN 103588260 A 2/2014
EP 0654292 A2 5/1995
WO 8500990 A1 3/1985

OTHER PUBLICATIONS

International Search Report and Written Opinion for International Application No. PCT/US2018/038942 dated Sep. 24, 2018.
(Continued)

*Primary Examiner* — Bradley R Spies
(74) *Attorney, Agent, or Firm* — Andrus Intellectual Property Law, LLP

(57) ABSTRACT

A hydrocyclone separator and a system that includes a plurality of such hydrocyclone separators are presented. The hydrocyclone separator includes a head portion having an inlet conduit and an overflow discharge tube arranged in the head portion. The hydrocyclone separator further has an apex discharge port and a tapered separation portion arranged between the head portion and the apex discharge port. The tapered separation portion is tapering distally away from the head portion. Moreover, the head portion further includes an emptying port arranged in the head portion separately from the overflow discharge tube. Hereby, a hydrocyclone separator capable of achieving improved operational efficiency with reduced risk of coarse fraction being misplaced and left in the head portion is presented. This effectively reduces maintenance needs and prolongs the lifespan of the hydrocyclone.

13 Claims, 4 Drawing Sheets

(51) Int. Cl.
*B04C 5/23* (2006.01)
*B04C 5/24* (2006.01)

(56) References Cited

OTHER PUBLICATIONS

Search Report for corresponding Chilean Patent Application No. 201903750 dated Nov. 13, 2020.
Office Action for corresponding Kazakhstan Patent Application No. 2019/0931.21.

* cited by examiner

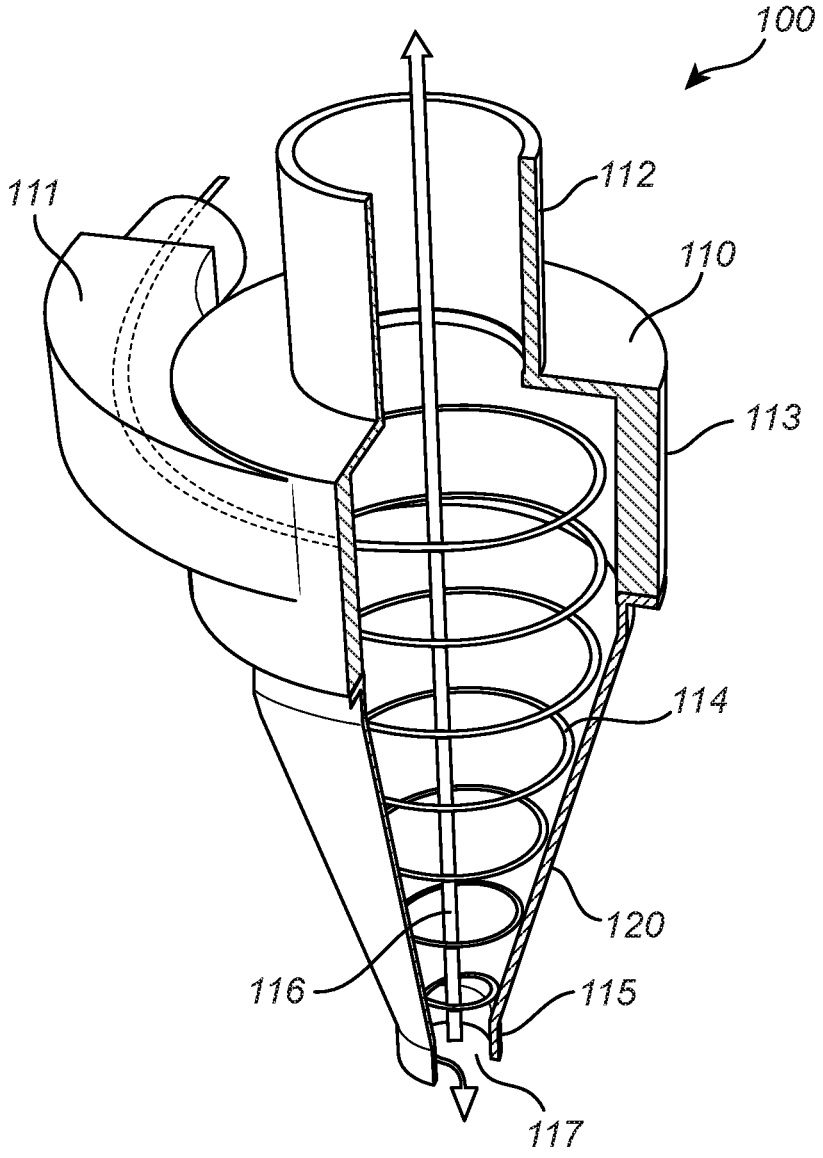
(Prior art) Fig. 1

HYDROCYCLONE SEPARATOR

CROSS-REFERENCE TO RELATED APPLICATIONS

This application is the U.S. national stage application of International Application PCT/US2018/038942, filed Jun. 22, 2018, which international application was published on Dec. 27, 2018, as International Publication WO 2018/237240 A1 in the English language. The International Application claims priority of European Patent Application No. 17177481.3 filed Jun. 22, 2017.

TECHNICAL FIELD OF THE INVENTION

The present invention relates to an apparatus for classifying particulate material, such as e.g. aggregates. More specifically the present invention relates to hydrocyclone separator for classifying solid material in liquid suspension.

BACKGROUND

Hydrocyclone separators (may also simply be referred to as hydrocyclones) are known to be useful for the classification or fractionation of coarse from fine solids suspended in a liquid. In general, a hydrocyclone is an enclosed vortical apparatus usually comprising a short cylindrical section (head portion) followed by a tapered (such as conical) section. Feed of a suspension of solids is supplied under predetermined pressure tangentially or in a volute path into the head portion so as to create therein a swirling stream of fluid, which stream follows a path of gradually decreasing radius toward the point of the narrowest radius of the cone, commonly known as the apex.

As the spiral path approaches the apex of the hydrocyclone, a portion of it turns and begins to flow towards the opposite end, i.e. towards the cylindrical section. Also this flow is in a spiral path of radius smaller than the radius of the first spiral while rotating in the same direction. Thus a vortex is generated within the hydrocyclone. The pressure will be lower along the central axis of the vortex and increase radially outwardly. The idea is that the hydrocyclone will separate the particles of the slurry according to shape, size and specific gravity with faster settling particles moving towards the outer wall of the hydrocyclone eventually leaving the hydrocyclone through the apex discharge port. Slower settling particles will move towards the central axis and travel towards the head portion, eventually leaving the hydrocyclone through the overflow discharge tube. The overflow discharge tube is normally extending down into the cylindrical section such that short circuiting of the feed is prevented, the portion extending down into the cylindrical section is often referred to as a vortex finder.

The efficiency of this operation, that is the sharpness of the separation of the coarser from the finer particles, depends on various factors, such as e.g. the size of the apex opening, the feed speed, and the density of the material to be separated and classified. Also the length of the conical section from the cylindrical part to the apex opening will have an impact on the operation of the separation and/or classification.

This separation according to shape, size and specific gravity is sometimes referred to as "stratification". However, this stratification of the material is not always fully achieved thus causing incomplete classification. Further, another problem that is known to occur is that a misplaced coarse fraction often ends up in the cylindrical head portion. If the misplaced fraction isn't removed from the head portion it will swirl around and tear on the inner walls of the head portion and consequently cause an increased need for maintenance and/or even require a complete replacement of the head portion. In severe cases, the misplaced coarse fraction may even pose a risk to operators. This problem with misplaced coarse fraction is even more prominent in systems where the hydrocyclone separators are arranged to operate in a partly or completely upside down configuration (i.e. configurations where the apex is vertically elevated relative to the overflow discharge port).

To this date it is common to disassemble parts of the head portion or the entire head portion in order to remove the misplaced coarse fraction. This operation is however time consuming and work intensive, and therefore it negatively impacts operational efficiency and costs.

Thus, there is still a need for improvements in this technical field, and more specifically there is a need for a hydrocyclone separator which provides for good separation but at the same time at least partly mitigates some of these problems or drawbacks of presently known systems related to the misplaced coarse fraction in the head portion.

SUMMARY OF THE INVENTION

It is therefore an object of the present invention to provide a hydrocyclone separator and for classifying solid material in liquid suspension, which alleviates all or at least some of the above-discussed drawbacks of the presently known systems.

In the following, the term exemplary is to be understood as serving as an example, instance, or illustration.

This object is achieved by means of a hydrocyclone separator for classifying solid material in liquid suspension, comprising:

a head portion;

an inlet conduit adapted to feed a suspension into the head portion;

an overflow discharge tube arranged in the head portion;

an apex discharge port;

a tapered separation portion arranged between the head portion and the apex discharge port, the tapered separation portion having a proximal end and a distal end, and wherein the tapered separation portion tapers towards the distal end;

characterized in that the head portion further comprises an emptying port arranged in the head portion separately from the overflow discharge tube.

Hereby, a hydrocyclone separator capable of achieving improved operational efficiency with reduced risk of coarse fraction being misplaced and left in the head portion is presented. This effectively reduces maintenance needs and prolongs the lifespan of the hydrocyclone.

In the context of the present disclosure, the term distal or distally is to be construed as towards the apex discharge port and the term proximal or proximally is to be construed as towards the head portion. Moreover, the terms overflow and underflow are considered represent their normal meaning in the art, in spite of the fact that the inventive hydrocyclone may be configured to be used in an upside-down orientation, making the overflow outlet (i.e. outlet of light components) arranged "below" the underflow outlet (i.e. outlet of heavy components).

The proximal end of the tapered separation portion may be connected directly to the head portion, or alternatively, the hydrocyclone separator may further comprise an intermediate (spacer) part or portion arranged between the head portion and the proximal end of the tapered separation portion.

The term "upside-down configuration" (may also be referred to as an inverted or semi-inverted configuration) is to be understood as that, in use, the hydrocyclone separator is oriented such that the apex discharge port is at a vertically elevated position relative to the overflow discharge tube. Stated differently, in use, the elongated center axis of the hydrocyclone forms an angle in the range of 91°-269° relative to a vertical reference axis, if a perfectly straight, conventional, configuration is considered to be 0°. A perfectly straight configuration is where the overflow discharge port is arranged straight above the apex discharge port and the center axis is perfectly vertical. Thus, the term "upside-down configuration" is not necessarily to be construed as limited to only a 180° orientation, where the apex discharge port is straight above the overflow discharge port.

The present inventors realized that by providing an emptying port, separate from the overflow discharge tube, which can be used to collect or discard the residue material that gets trapped within the head portion during operation, advantages in terms of reduced maintenance needs, increased lifespan and faster and less work intensive maintenance can be achieved. The emptying port provides for a simple and efficient means for cleaning the head portion between operation, wherefore, the need for the otherwise labor-intensive disassembling procedure required for removing trapped residual material is diminished. Thereby decreasing operational costs and improving operational efficiency.

The inventors further realized that, when hydrocyclone separator is used in an upside-down configuration, there is a particular advantage with the present invention in that the operational efficiency can be increased without being at the cost of increased maintenance needs and reduced lifespan. In more detail, in prior known solutions with hydrocyclones operating in an upside down configuration, there often an amount of residue material, in the form of coarse particles, which get trapped in the head portion since they are too heavy to be picked up by the upwardly spiraling whirl. Thus, the coarse particles are left whirling around within the head portion where they bump and scrape against the inner walls of the head portion causing undesired wear and tear which reduces the overall lifespan of the hydrocyclone.

Moreover, in accordance with at least one exemplary embodiment of the present invention, the emptying port is provided with a closing arrangement for selectively opening and closing the emptying port.

Further, in accordance with at least one exemplary embodiment, the hydrocyclone separator further comprises a set of fluid injection nozzles arranged in the head portion for injecting a secondary fluid into the head portion. The fluid injection nozzles are advantageously used during maintenance, e.g. for facilitating internal cleaning of the head portion whereby the trapped residual material can be "washed" out via the emptying pocket which forms a type of washout drain.

Even further, in accordance with at least one exemplary embodiment, the emptying port further comprises a settling pocket comprising an internal chamber for collecting residual coarse feed material. The pocket arrangement allows for collection of coarse (potentially hazardous) feed material which are stuck in the head portion during operation, thereby further reducing the risk of internal wear and tear of the head portion. The settling pocket may further comprise a closeable access port which is accessible externally from the hydrocyclone separator for removing collected residual coarse feed material from said internal chamber. Thus, the residual coarse particles are effectively collected and safely stored in the settling pocket which can be emptied periodically as part of a maintenance procedure.

Furthermore, in accordance with at least one exemplary embodiment, the emptying port is arranged at a lowest point of the head portion when said hydrocyclone separator is oriented such that said apex discharge port is at a vertically elevated position relative to the overflow discharge tube. The relatively heavy particles which are trapped within the head portion during operation will be drawn by gravity towards the lowest point of the head portion, therefore by arranging the emptying port at the lowest point of the head portion efficient collection of the residual coarse material can be achieved. For example, by arranging the hydrocyclone in a tilted upside down orientation, (e.g. rotating the hydrocyclone 135°-155° from a conventional straight orientation), a corner or edge section of the head portion will form a lowest point, whereby the emptying port may be arranged in that section.

Even further, in accordance with at least one exemplary embodiment, the head portion comprises a disc-shaped end portion surrounding the overflow discharge tube, where the emptying port is arranged in the disc-shaped end portion. The disc-shaped end portion may also be known as a "cover" of the head portion, and is the part of the head portion through which the overflow discharge tube extends (including the vortex finder). The emptying port may for example be arranged at a peripheral end of the disc-shaped end portion (i.e. the cover). In the previously discussed "tilted upside down configuration", the lowest point may be at the peripheral end of the disc-shaped end portion, wherefore it is advantageous to arrange the emptying port within that area/section.

Yet further, in accordance with at least one exemplary embodiment the head portion comprises a disc-shaped end portion surrounding said overflow discharge tube and a substantially cylindrical wall portion, and wherein said emptying port is arranged in said wall portion, preferably adjacent to the disc-shaped end portion. Thus, instead of arranging the emptying port in the "cover" part of the head portion it can be arranged in the cylindrical wall portion.

Moreover, in accordance with at least one exemplary embodiment, the fluid injection nozzles are arranged in the disc-shaped end portion. As previously mentioned, the fluid injection nozzles are advantageously used during maintenance, e.g. for facilitating internal cleaning of the head portion whereby the trapped residual material can be "washed" out via the emptying pocket which forms a type of washout drain.

Even further, in accordance with at least one exemplary embodiment, the disc-shaped end portion comprises an internal surface facing towards an interior of the hydrocyclone separator, the internal surface being slanted relative to a horizontal plane when the hydrocyclone separator is oriented such that the apex discharge port is at a vertically elevated position relative to the overflow discharge tube; and wherein the emptying port is arranged at a lowest end of the internal surface along a vertical direction relative to the horizontal plane when the hydrocyclone separator is oriented such that the apex discharge port is at the vertically elevated position relative to the overflow discharge tube. The lowest end of the internal surface along the vertical direction will accordingly include the lowest point of the head portion when the hydrocyclone is in an upside down orientation. Moreover, the internal surface may be slanted relative to an elongated central axis of the hydrocyclone separator, or alternatively, the internal surface may be perpendicular to the elongated central axis but the whole hydrocyclone separator may be arranged in a tilted upside down configuration (e.g. rotated 135° from the conventional straight configuration).

Yet further, in accordance with at least one exemplary embodiment, the head portion comprises:

an end portion surrounding the overflow discharge tube; and wherein the end portion comprises an internal surface facing towards an interior of the hydrocyclone separator, the internal surface having at least two surface portions arranged at different heights relative to a horizontal plane when the hydrocyclone separator is oriented such that the apex discharge port is at a vertically elevated position relative to the overflow discharge tube; and wherein the emptying port is arranged on a surface portion which is arranged a lowest height relative to the horizontal plane of the at least two surface portions when the hydrocyclone separator is oriented such that the apex discharge port is at the vertically elevated position relative to the overflow discharge tube. For example, in a cross-section taken along the elongated central axis of the hydrocyclone separator, the end portion of the head portion have a V-shape. Thus, when the hydrocyclone separator is in an upside down orientation, the bottom of the "V" will form the lowest point of the head portion. Therefore, by arranging the emptying port at the bottom of the "V", the gravitational pull will help with discharging the trapped residual coarse material. Moreover, the head portion may comprise a plurality of emptying ports, e.g. one on each side of the overflow discharge tube.

In accordance with another aspect of the present invention, there is provided a system comprising a plurality of hydrocyclone separators according to any one of the embodiments discussed in reference to the first aspect of the present invention. Thus, with this aspect of the invention, similar advantages and preferred features are obtained as in the previously discussed first aspect of the invention.

These and other features of the present invention will in the following be further clarified with reference to the embodiments described hereinafter.

BRIEF DESCRIPTION OF THE DRAWINGS

For exemplifying purposes, the invention will be described in closer detail in the following with reference to embodiments thereof illustrated in the attached drawings, wherein:

FIG. 1 is a partial cut-through perspective view illustration of a hydrocyclone separator as known in the prior art;

DETAILED DESCRIPTION

Figures 2A, 2B:
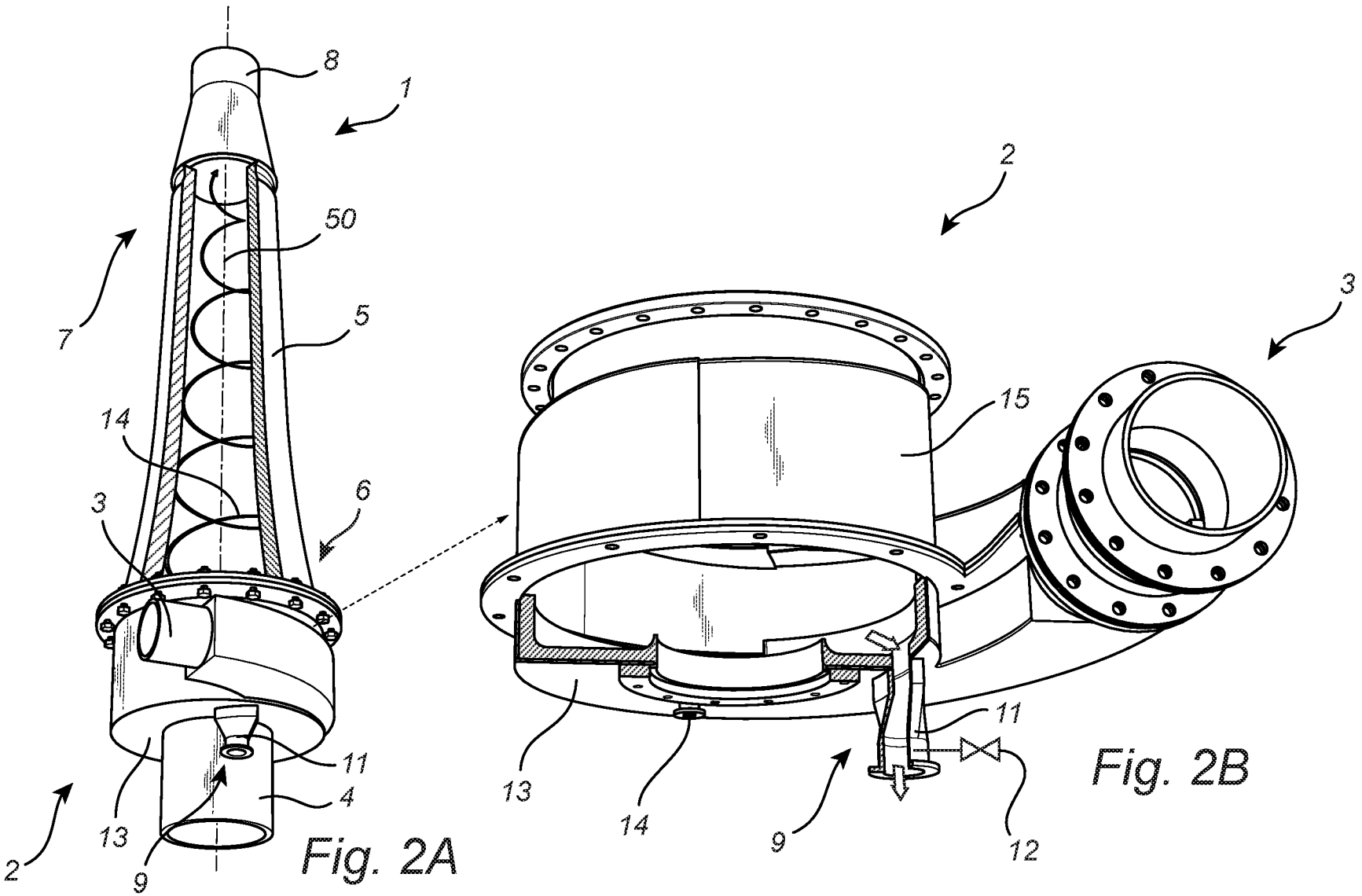
FIG. 2A is a partial cut-through perspective view illustration of a hydrocyclone separator in accordance with an embodiment of the present invention.
FIG. 2B is an enlarged partial cut-through perspective view of the head portion of the hydrocyclone separator illustrated in FIG. 2A.

In the following detailed description, example embodiments of the present invention will be described. However, it is to be understood that features of the different embodiments are exchangeable between the embodiments and may be combined in different ways, unless anything else is specifically indicated. Even though in the following description, numerous specific details are set forth to provide a more thorough understanding of the present invention, it will be apparent to one skilled in the art that the present invention may be practiced without these specific details. In other instances, well known constructions or functions are not described in detail, so as not to obscure the present invention. Like reference characters refer to like elements throughout. Naturally the skilled reader understands that terms such as up, down, inwards or outwards are relative and in reference to the illustrated embodiments and should not be construed as limiting to the invention.

FIG. 1 shows a schematic view of a prior art hydrocyclone separator 100. That hydrocyclone separator 100 (or simply "hydrocyclone") comprises a cylindrical head portion 110. An inlet conduit 111 is arranged to feed a suspension of solid material into the cylindrical head portion 110, and an overflow discharge tube 112 is arranged axially through the top of the cylindrical head portion 110. The cylindrical head portion 110 is connected with a conically tapered separation part 120. The slurry is typically fed tangentially or in a volute path through the outer wall 113 of the head portion 110, thus creating a whirling motion 114 of the slurry which follows a path of gradually decreasing radius toward the point of the narrowest radius of the cone 120 and apex 115. As the spiral path approaches the apex 115 of the hydrocyclone 100, a portion 116 of it turns and begins to flow towards the opposite end, i.e. towards the head portion 110. Also this flow 116 is in a spiral path of radius smaller than the radius of the first spiral 114 while rotating in the same direction. Thus a vortex is generated within the hydrocyclone 100. The pressure will be lower along the central axis of the vortex and increase radially outwardly towards the outer wall 113 of the hydrocyclone 100. The hydrocyclone 100 will separate the particles of the slurry according to shape, size and specific gravity with faster settling particles moving towards the outer wall of the hydrocyclone 100 eventually leaving the hydrocyclone through the underflow 117. Slower settling particles will move towards the central axis and travel upwardly, eventually leaving the hydrocyclone through a discharge tube 112 (overflow). The discharge tube 112 is normally extending down into the head portion 110 such that a short circuiting of the feed is prevented (often referred to as a vortex finder, not shown). This separation according to shape, size and specific gravity can be denominated "stratification".

FIGS. 2A and 2B illustrate a partial cut-through perspective view of a hydrocyclone separator 1 suitable for classifying solid material in liquid suspension. The hydrocyclone separator 1 has a head portion 2 having an inlet conduit 3 adapted to feed a suspension into the head portion 2. The head portion 2 is here illustrated as being cylindrical. However, as is already apparent for the skilled reader, further shapes are feasible, such as e.g. a cone shape (having a cone angle in the range of 0 to 20 degrees) or a curved shape. Moreover, the hydrocyclone 1 has an overflow discharge tube 4, arranged axially in the head portion 2. However, the overflow discharge tube 4 may also be arranged in other orientations in the head portion 2 (e.g. slanted or off-center).

Further, the hydrocyclone 1 has a tapered separation portion 5 with a proximal end 6 and a distal end 7. The proximal end 7 is connected to the head portion and the tapered separation portion 5 tapers towards the distal end 7. The head portion 2 is here shown as a removable or detachable part which is joined together with the tapered separation portion along a flange, however, other embodiments where the two parts are integrated in a single piece are feasible. Also, the hydrocyclone separator 1 may comprise an intermediate cylindrical (spacer) part arranged between the head portion 2 and the tapered separation portion 5 (not shown). Moreover, the tapered separation portion 5 may be a conically tapered separation portion, having a continuously decreasing cone angle, i.e. trumpet-shaped (as illustrated in FIG. 2A). Alternatively, the tapered separation portion 5 may have two or more tapered sections having different cone angles with larger cone angles close to the head portion 2 (at the proximal end 6) and smaller cone angles further away from the head portion 2 towards the distal end 7. In yet another embodiment (not shown) the conically tapered separation portion 5 may comprise one tapered section having a single cone angle. The hydrocyclone separator 1 further comprises an apex discharge port 8 (underflow) arranged at the distal end 7 of the tapered separation portion 5.

The hydrocyclone 1 further includes an emptying port 9 arranged in the head portion 2, as illustrated in more detail in FIG. 2B. The emptying port 9 is arranged separately from the overflow discharge tube 4 (the protruding part of the overflow discharge tube has been removed from FIG. 2B in order to emphasize other parts of the head portion 2). Here, the emptying port 9 is arranged in the end portion 13 (may also be referred to as a cover), here being a disc-shaped end portion, which surrounds the overflow discharge tube 4. The emptying port 9 further comprises a settling pocket 11 which has an internal chamber for collecting residual coarse feed material that has become trapped within the head portion 2. The settling pocket 11 forms a type of intermediate storage for the trapped coarse particles during operation of the hydrocyclone separator 1, effectively reducing the time that the misplaced/trapped coarse particles are left swirling within the head portion. The settling pocket 11 is furthermore provided with a closeable access port 12 (schematically indicated as a valve in the drawing) which is accessible externally from the hydrocyclone separator in order to be able to remove collected residual coarse feed material from the internal chamber of the settling pocket 11.

The head portion 2 further has a set of fluid nozzles 14 arranged in the disc-shaped end portion (cover) 13 for injecting a secondary fluid (e.g. water) into the head portion. The fluid nozzles 14 serve to facilitate cleaning of the head portion, and may be utilized to perform a flush through of the head portion 2 during e.g. a maintenance procedure.

Figure 3:
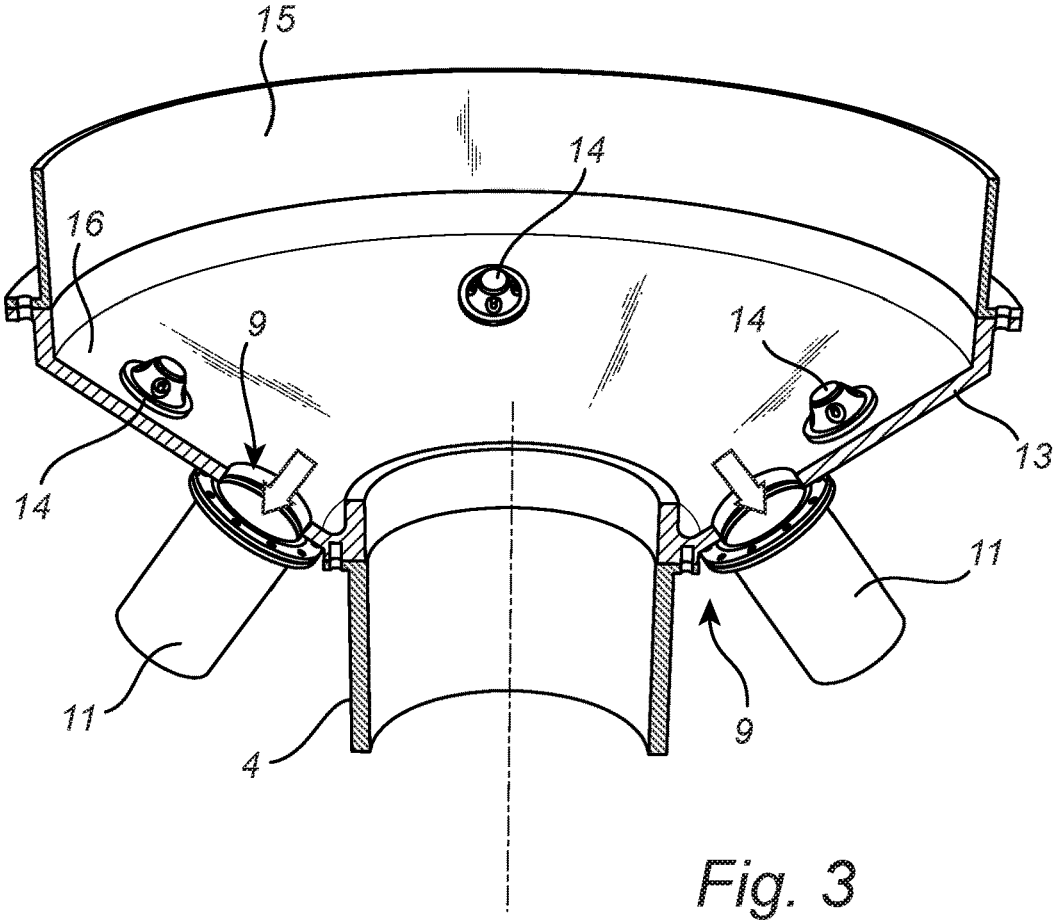
FIG. 3 is a cross-sectional perspective view of a head portion of a hydrocyclone separator in accordance with an embodiment of the invention.

FIG. 3 illustrates a cross-sectional perspective view of a head portion 2 of a hydrocyclone separator in accordance with an embodiment of the invention. The cross-section being taken along an elongated central axis 50 of the hydrocyclone. The head portion comprises two emptying ports 9 having separate settling pockets 11 having internal chambers for collecting residual coarse feed material. The emptying ports 9 are arranged at the spatially lowest sections of the head portion 2 when the hydrocyclone separator is oriented such that the apex discharge port is at a vertically elevated position relative to the overflow discharge tube 4, i.e. in an upside down configuration/orientation. The head portion 2 has an end portion 13 (may be referred to as a cover) which surrounds the overflow discharge tube 4. The end portion 13 has an internal surface 16 facing towards an interior of the hydrocyclone separator, and having a slanted or conical structure. More specifically, the internal surface 16 is downwardly sloped inwards towards a central axis and towards the overflow discharge tube 4, when the hydrocyclone is in an upside down configuration.

Stated differently, the internal surface 16 has two surface portions, an outer edge area proximal to the cylindrical wall 15 of the head portion, and an inner area proximal to the overflow discharge tube 4. The two surface portions are accordingly arranged at different heights relative to a horizontal plane (perpendicular to the axis 50) and the emptying ports 9 are arranged on the surface portion which is at the lowest height relative to the horizontal plane of the at least two surface portions, when the hydrocyclone is in the upside down configuration. This facilitates the collection of the residual coarse feed material which is stuck or trapped within the head portion 2 during operation, since it will gather at the lowest point within the head due to gravity. The head portion 2 further has a set of fluid nozzles 14 arranged in the "conical" end portion (cover) 13. The fluid nozzles 14 are configured to inject a secondary fluid (e.g. water) into the head portion. The fluid nozzles 14 facilitate cleaning of the head portion, and may be utilized to perform a flush through of the head portion 2 during e.g. a maintenance procedure.

Figure 4:
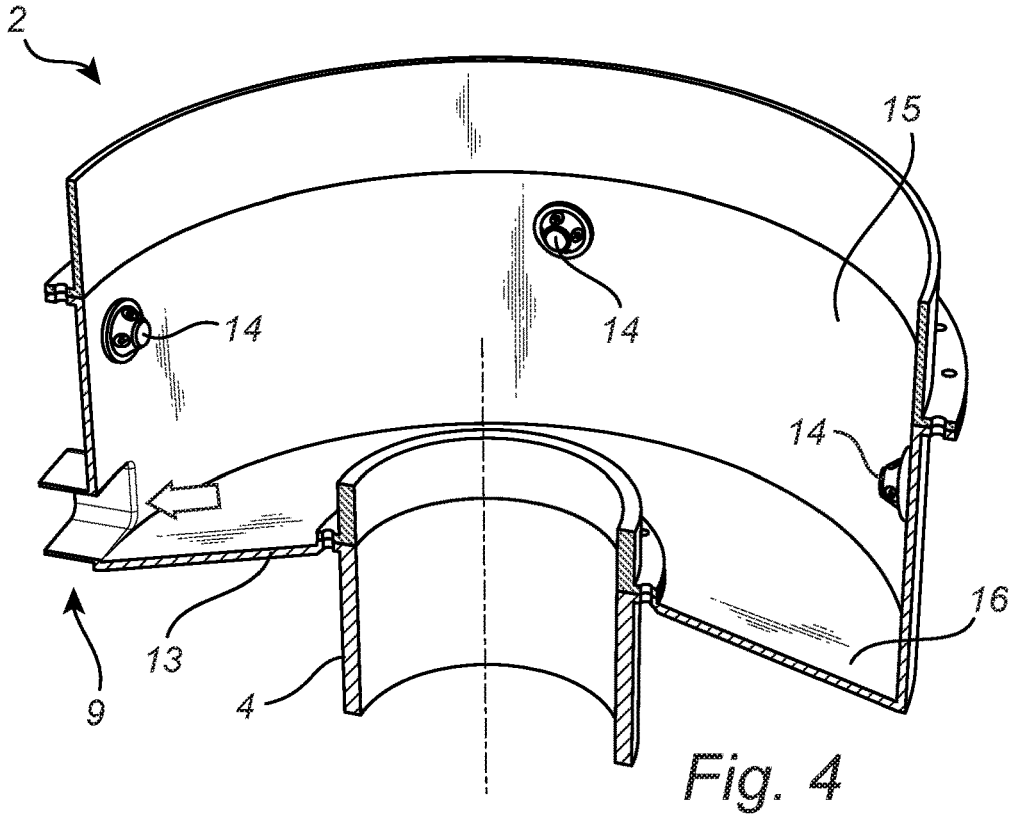
FIG. 4 is a cross-sectional perspective view of a head portion of a hydrocyclone separator in accordance with another embodiment of the invention.

FIG. 4 illustrates a cross-sectional perspective view of a head portion 2 of a hydrocyclone separator in accordance with another embodiment of the invention. The cross-section being taken along an elongated central axis 50 of the hydrocyclone. The head portion 2 has an end portion 13 surrounding the overflow discharge tube 4, the end portion 13 having an internal surface 16 facing towards the interior of the head portion 2 and the overall hydrocyclone separator.

Moreover, the head portion 2 has a cylindrical or tubular wall portion 15 and an emptying port 9 arranged in this cylindrical wall portion 15. The emptying port 9 is arranged or situated in the wall portion adjacent to the end portion 13. The end portion 13 is generally disc shaped with a slope forming a conical internal surface 16. Stated differently, the internal surface 16 is slanted relative to a horizontal plane (reference plane) when the hydrocyclone is arranged in an upside down orientation. Further, the head portion 2 has a set of fluid injection nozzles 14 arranged in the cylindrical wall portion 15, the fluid nozzles 14 being configured to inject a secondary fluid (e.g. water) into the head portion.

Figure 5A:
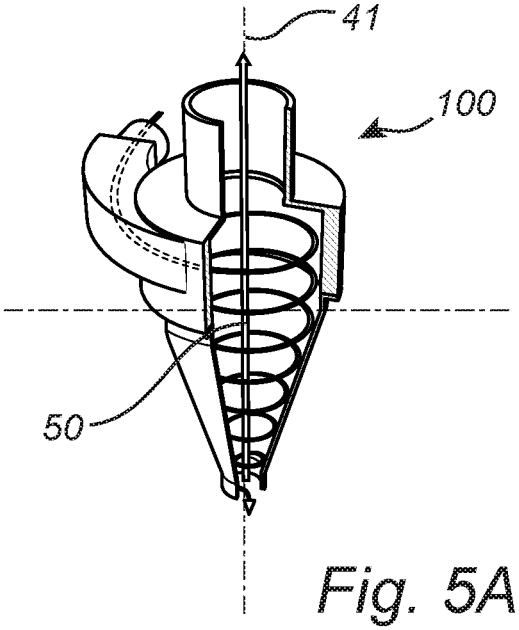
FIG. 5A is a schematic side view illustration of a prior art hydrocyclone separator arranged in straight conventional (0°) orientation.

FIG. 5A shows a schematic illustration of a prior art hydrocyclone separator 100 from a side view perspective. The hydrocyclone separator 100 is arranged in a conventional straight (0°) configuration. The elongated central axis 50 of the hydrocyclone 100 is aligned with a vertical axis 41 (y-axis), forming an angle of 0° between the vertical axis 41 (y-axis) and the elongated central axis 50.

Figure 5B:
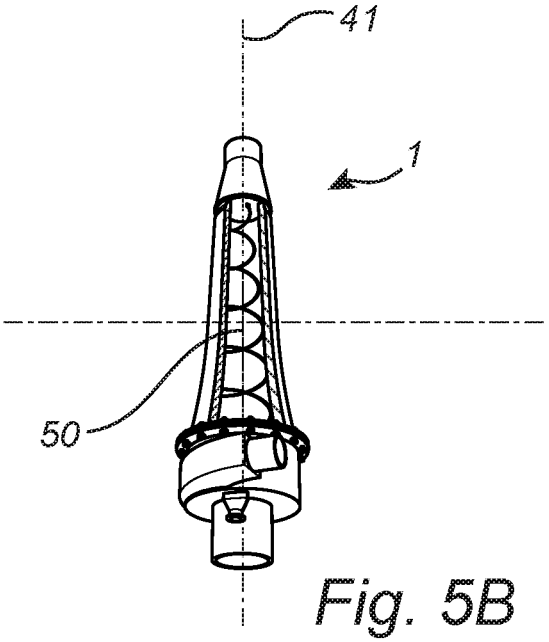
FIG. 5B is a schematic side view illustration of a hydrocyclone separator arranged in an upside down (180°) orientation in accordance with an embodiment of the present invention.

FIG. 5B shows a schematic illustration of a hydrocyclone separator 1 from a side view perspective, in accordance with an embodiment of the present invention. The hydrocyclone 1 is oriented in a straight upside down configuration (also known as an inverted configuration), where the elongated central axis 50 of the hydrocyclone 1 is rotated by 180° relative to the vertical axis 41 (rotated from a conventional straight configuration). In this orientation, shown in FIG. 5B, the head portion may be arranged as illustrated in FIG. 3 or FIG. 4 whereby the emptying port(s) would be arranged at a lowest end/point of the head portion, improving the probability of residual coarse material being collected in the settling pocket.

Figure 5C:
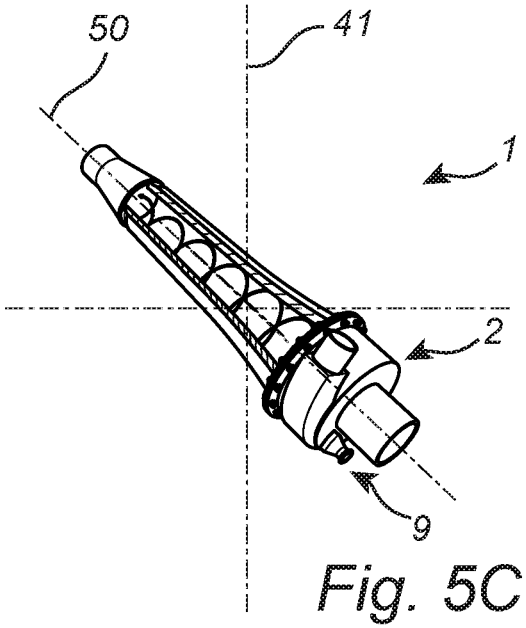
FIG. 5C is a schematic side view illustration of a hydrocyclone separator arranged in an upside down (225°) orientation in accordance with an embodiment of the present invention.

FIG. 5C shows a schematic illustration of a hydrocyclone separator 1 from a side view perspective, in accordance with another embodiment of the present invention. Here, the hydrocyclone 1 is arranged in another upside down orientation/configuration (also known as a semi-inverted configuration), where the elongated central axis 50 of the hydrocyclone is rotated by approx. 225° relative to the vertical axis 41 (rotated from a conventional straight configuration). Here, the emptying port is arranged at a lowest point of the head portion. More specifically, the emptying port is arranged at an outer peripheral edge of the cover (disc-shaped end portion) of the head portion. Accordingly, by arranging the whole hydrocyclone in a "tilted" upside down orientation, the emptying port can be provided at the lowest point of the head portion.

Figure 5D:
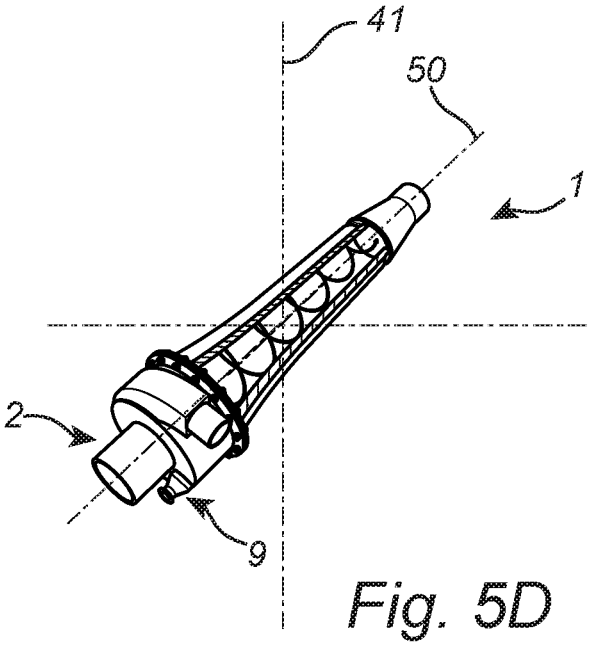
FIG. 5D is a schematic side view illustration of a hydrocyclone separator arranged in an upside down (135°) orientation in accordance with an embodiment of the present invention.

FIG. 5D shows a schematic illustration of a hydrocyclone separator 1 from a side view perspective, in accordance with yet another embodiment of the present invention. Here, the hydrocyclone 1 is arranged in another upside down orientation/configuration (also known as a semi-inverted configuration), where the elongated central axis 50 of the hydrocyclone is rotated by approx. 135° relative to the vertical axis 41 (rotated from a conventional straight configuration). Similarly, as in FIG. 5C, the emptying port is here, in FIG. 5D, arranged at a lowest point of the head portion. Even though only some specific examples were selected in FIGS. 5B-5D, the hydrocyclone separator may be oriented such that it is rotated by any number of degrees in the range of 91°-269° relative to a vertical axis, such as e.g. 100°, 110°, 125°, 170°, 235°, etc.

Furthermore, the skilled person realizes that a number of modifications of the embodiments described herein are possible without departing from the scope of the invention, which is defined in the appended claims. For example, the separation part according to the invention need not necessarily be conical in a strict meaning. As long as the inner diameter is generally reduced from a top end towards a bottom end, it can have a plurality of different cone angles along its longitudinal axis and can also have more of a curved appearance, i.e. having a continuously changing cone angle. Moreover, the head portion may have various shapes and configurations in order to arrange the emptying port at a lowest point of the hydrocyclone when it is in an upside down orientation, as already apparent for the skilled reader. Variations to the disclosed embodiments can be understood and effected by the skilled addressee in practicing the claimed invention, from a study of the drawings, the disclosure, and the appended claims. Furthermore, in the claims, the word "comprising" does not exclude other elements or steps, and the indefinite article "a" or "an" does not exclude a plurality.

The invention claimed is:

1. A hydrocyclone separator for classifying solid material in liquid suspension, comprising:

a head portion comprising an inlet conduit adapted to feed a suspension into the head portion;

an overflow discharge tube arranged in the head portion;

an underflow discharge port;

a tapered separation portion arranged between the head portion and the underflow discharge port, the tapered separation portion having a proximal end facing the head portion and a distal end facing the underflow discharge port, and wherein said tapered separation portion tapers towards said distal end;

wherein said head portion further comprises an emptying port arranged in the head portion separately from the overflow discharge tube.

2. The hydrocyclone separator according to claim 1, wherein said emptying port is provided with a closing arrangement for selectively opening and closing said emptying port.

3. The hydrocyclone separator according to claim 1, further comprising a set of fluid injection nozzles arranged in the head portion for injecting a secondary fluid into said head portion.

4. The hydrocyclone separator according to claim 1, wherein said emptying port comprises a settling pocket comprising an internal chamber for collecting residual coarse feed material.

5. The hydrocyclone separator according to claim 4, wherein said settling pocket comprises a closeable access port which is accessible externally from the hydrocyclone separator for removing collected residual coarse feed material from said internal chamber.

6. The hydrocyclone separator according to claim 1, wherein said emptying port is arranged at a lowest point of the head portion when said hydrocyclone separator is oriented such that said apex discharge port is at a vertically elevated position relative to the overflow discharge tube.

7. The hydrocyclone separator according to claim 1, wherein said head portion comprises:

a disc-shaped end portion surrounding said overflow discharge tube; and wherein said emptying port is arranged in said disc-shaped end portion.

8. The hydrocyclone separator according to claim 7, wherein said emptying port is arranged at a peripheral end of said disc-shaped end portion.

9. The hydrocyclone separator according to claim 1, wherein said head portion comprises:

a disc-shaped end portion surrounding said overflow discharge tube, and a substantially cylindrical wall portion; and wherein said emptying port is arranged in said substantially cylindrical wall portion, adjacent to the disc-shaped end portion.

10. The hydrocyclone separator according to claim 7, wherein a set of fluid injection nozzles are arranged in said disc-shaped end portion for injecting a secondary fluid into said head portion.

11. The hydrocyclone separator according to claim 7, wherein said disc-shaped end portion comprises an internal surface facing towards an interior of the hydrocyclone separator, said internal surface being slanted relative to a horizontal plane when said hydrocyclone separator is oriented such that said apex discharge port is at a vertically elevated position relative to the overflow discharge tube; and wherein said emptying port is arranged at a lowest end of said internal surface along a vertical direction relative to the horizontal plane when said hydrocyclone separator is oriented such that said apex discharge port is at the vertically elevated position relative to the overflow discharge tube.

12. The hydrocyclone separator according to claim 1, wherein said head portion comprises:

an end portion surrounding said overflow discharge tube; and wherein said end portion comprises an internal surface facing towards an interior of the hydrocyclone separator, said internal surface having at least two surface portions arranged at different heights relative to a horizontal plane when said hydrocyclone separator is oriented such that said apex discharge port is at a vertically elevated position relative to the overflow discharge tube; and wherein said emptying port is arranged on a surface portion which is arranged a lowest height relative to the horizontal plane of the at least two surface portions when said hydrocyclone separator is oriented such that said apex discharge port is at the vertically elevated position relative to the overflow discharge tube.

13. A system comprising a plurality of hydrocyclone separators according to claim 1.

* * * * *